US012410580B2

(12) United States Patent
Coppersmith

(10) Patent No.: US 12,410,580 B2
(45) Date of Patent: Sep. 9, 2025

(54) EXCAVATOR BOOM EXTENSION

(71) Applicant: Chad Coppersmith, Ft. Pierce, FL (US)

(72) Inventor: Chad Coppersmith, Ft. Pierce, FL (US)

( * ) Notice: Subject to any disclaimer, the term of this patent is extended or adjusted under 35 U.S.C. 154(b) by 327 days.

(21) Appl. No.: 18/307,900

(22) Filed: Apr. 27, 2023

(65) Prior Publication Data

US 2024/0125083 A1 Apr. 18, 2024

Related U.S. Application Data

(60) Provisional application No. 63/416,853, filed on Oct. 17, 2022.

(51) Int. Cl.

| | |
|---|---|
| ***E02F 3/36*** | (2006.01) |
| ***E02F 3/32*** | (2006.01) |
| ***E02F 3/38*** | (2006.01) |

(52) U.S. Cl.

CPC ..... *E02F 3/369* (2013.01); *E02F 3/325* (2013.01); *E02F 3/3609* (2013.01); *E02F 3/3677* (2013.01); *E02F 3/382* (2013.01)

(58) Field of Classification Search

CPC ..... E02F 3/369; E02F 3/325; E02F 3/3609; E02F 3/3677; E02F 3/382

See application file for complete search history.

(56) References Cited

U.S. PATENT DOCUMENTS

| | | | | |
|---|---|---|---|---|
| 1,898,453 | A * | 2/1933 | Lehman | E02F 3/382 212/175 |
| 4,641,439 | A * | 2/1987 | Shirek | E02F 3/382 414/739 |
| 5,993,139 | A * | 11/1999 | Deneve | E02F 3/382 414/722 |
| 6,116,847 | A * | 9/2000 | Ginn | E02F 3/283 414/722 |
| 9,970,177 | B2 * | 5/2018 | Koestler | E02F 3/365 |
| 10,066,363 | B1 * | 9/2018 | McGee, Jr. | F16C 33/20 |
| 11,035,094 | B1 * | 6/2021 | Ferguson | E02F 3/3405 |
| 2011/0150618 | A1 * | 6/2011 | Ramun | E02F 3/965 414/722 |
| 2016/0021823 | A1 * | 1/2016 | Hoppel | E02F 3/3677 280/98 |

FOREIGN PATENT DOCUMENTS

| | | | | |
|---|---|---|---|---|
| EP | 3553231 | A1 * | 10/2019 | A01D 87/0076 |
| GB | 2224483 | A * | 5/1990 | E02F 3/3405 |

* cited by examiner

*Primary Examiner* — Gerald McClain
(74) *Attorney, Agent, or Firm* — Kelly G. Swartz; Widerman Malek, PL

(57) ABSTRACT

A pin-on boom extension system for an excavator including a top bar, a bottom boom tube adapted to receive a free end of the excavator boom, the bottom tube including a first aperture aligned with a second aperture, a first securing pin adapted to extend through the first aperture and the second aperture, a first pivot bar secured to the bottom boom tube and to the top bar, the second pivot bar having the first end secured to the bottom boom tube and a second end secured to the top bar, a first adjustment plate extending from the first side of the bottom boom tube to the second side of the bottom boom tube, and a second adjustment plate extending from the first side of the bottom boom tube to the second side of the bottom boom tube.

19 Claims, 6 Drawing Sheets

EXCAVATOR BOOM EXTENSION

RELATED APPLICATIONS

This application claims priority under 35 U.S.C. § 119(e) of U.S. Provisional Patent Application Ser. No. 63/413,853 filed on Oct. 17, 2022 and titled EXCAVATOR BOOM EXTENSION. The content of this application is incorporated herein by reference.

FIELD OF THE INVENTION

The present invention relates to systems and methods for providing a boom extension for heavy machinery. More specifically, the present invention provides a pin-on boom extension that can be added to a mini-excavator between the existing boom and the attachment.

BACKGROUND OF THE INVENTION

A mini-excavator is a construction machine that can perform a variety of tasks such as digging and loading. A mini-excavator may be used by an operator positioned in the cab of the mini-excavator. The operator may drive the mini-excavator to a desired position and then operate the hydraulic boom and attachment of the mini-excavator to perform the desired function. The mini-excavator may need to be repositioned if the boom is not of a sufficient length to reach areas in which work needs to be done. Repositioning the mini-excavator can be time consuming and may damage the surface on which the mini-excavator is operating. This damage may be of particular concern when the mini-excavator is operated on sod. Therefore, a need exists for a device to extend the reach of a mini-excavator without the need to reposition the mini-excavator.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a pin-on boom extension system for an excavator. The excavator may have a boom and an attachment. The pin-on boom extension system may include a top bar, bottom boom tube, first securing pin, first pivot bar, second pivot bar, first adjustment plate, and second adjustment plate.

The top bar may have an attachment end and an opposing boom end.

The bottom boom tube may have an attachment end and an opposing boom end, which may be adapted to receive a free end of the boom. The bottom boom tube may include a first aperture and a second aperture. The first aperture may have a center and be located on a first side of the bottom boom tube between a first end of a first pivot bar and the attachment end of the bottom boom tube. The second aperture may have a center and be located on a second side of the bottom boom tube between a first end of a second pivot bar and the attachment end of the bottom boom tube. The center of the first aperture may be aligned with the center of the second aperture.

The first securing pin may be adapted to extend through the first aperture of the bottom boom tube and the second aperture of the bottom boom tube.

The first pivot bar may have the first end secured to the first side of the boom end of the bottom boom tube and a second end secured to the boom end of the top bar.

The second pivot bar may have the first end secured to the second side of the boom end of the bottom boom tube and a second end secured to the boom end of the top bar.

The first adjustment plate may have a lower surface and an opposing upper surface. The first adjustment plate may be positioned at an upper portion of the bottom boom tube proximate the boom end and may extend from the first side of the bottom boom tube to the second side of the bottom boom tube.

The second adjustment plate may have a lower surface and an opposing upper surface positioned proximate the lower surface of the first adjustment plate. The second adjustment plate may be positioned at a lower portion of the bottom boom tube proximate the boom end and may extend from the first side of the bottom boom tube to the second side of the bottom boom tube.

The bottom boom tube may include a third aperture, a fourth aperture, and a second securing pin. The third aperture may have a center and be located on a first side of the bottom boom tube between the first aperture and the attachment end of the bottom boom tube. The fourth aperture may have a center located on a second side of the bottom boom tube between the second aperture and the attachment end of the bottom boom tube. The second securing pin may be adapted to extend through the third aperture of the bottom boom tube and the fourth aperture of the bottom boom tube. The center of the third aperture may be aligned with the center of the fourth aperture.

The bottom boom tube may include a first tube located on the attachment end and extending from the first side of the bottom boom tube to the second side of the bottom boom tube.

The bottom boom tube may include a plate extending downwardly from a lower portion of the bottom boom tube proximate the boom end of the bottom boom tube. The plate may have an aperture extending entirely through a thickness of the plate.

The first pivot bar may include a first aperture and a second aperture. The first aperture may be formed through an entirety of a thickness of the first pivot bar on the first end of the pivot bar. The second aperture may be formed through an entirety of the thickness of the first pivot bar on the second end of the pivot bar.

The first adjustment plate may include a first threaded aperture and a second threaded aperture. The first threaded aperture may be located through an entirety of a thickness of the first adjustment plate. The second threaded aperture may be located through an entirety of the thickness of the first adjustment plate.

The first adjustment plate may include a third aperture located through an entirety of the thickness of the first adjustment plate.

The first adjustment plate may include a fourth threaded aperture and a fifth threaded aperture. The fourth threaded aperture may be located through an entirety of a thickness of the first adjustment plate. The fifth threaded aperture may be located through an entirety of the thickness of the first adjustment plate.

The second adjustment plate may include a first threaded aperture and a second threaded aperture. The first threaded aperture may be located through an entirety of a thickness of the second adjustment plate. The second threaded aperture may be located through an entirety of the thickness of the second adjustment plate.

The boom extension system may include a first wear plate, which may be positioned between the first adjustment plate and the second adjustment plate.

The boom extension system may include a second wear plate, which may be positioned between the second adjustment plate and the first wear plate.

The first wear plate may include a pin extending orthogonally from a surface of the first wear plate proximate the first adjustment plate. The pin may extend through an alignment hole disposed through an entirety of a thickness of the first adjustment plate.

The pivot bar may be rotatably secured to the boom end of the bottom bar and the boom end of the top bar.

The top bar may be rotatably secured to first pivot bar and rotatably secured to the second pivot bar.

The top bar may include a first tube and a second tube. The first tube may have a center located at the boom end. The second tube may have a center located at the boom end. The center of the first tube may be aligned with the center of the second tube.

The top bar may include an elongated cylindrical member and a spreader bar. The spreader bar may have a first end and an opposing second end and a first side and an opposing second side. The first side of the spreader bar may be secured to a boom end of the elongated cylindrical member across a transverse axis of the elongated cylindrical member. An outer surface of the first tube may be secured to the second side of the spreader bar at the first end of the spreader bar. An outer surface of the second tube may be secured to the second side of the spreader bar at the second end of the spreader bar.

A notch may be formed along the second side of the spreader bar between the first tube and the second tube.

The top bar may have an aperture located at the attachment end, extending through an entirety of a thickness of the top bar from a first side to an opposing second side.

The top bar may include a threaded aperture and a threaded rod. The threaded aperture may be located at the attachment end of the top bar along a longitudinal axis of the top bar. The threaded rod may have a first end carried by the threaded aperture, a second, opposing end, and a securing member located on the second end of the threaded rod.

BRIEF DESCRIPTION OF THE DRAWINGS

Some embodiments of the present invention are illustrated as an example and are not limited by the figures of the accompanying drawings, in which like references may indicate similar elements.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Figure 12:
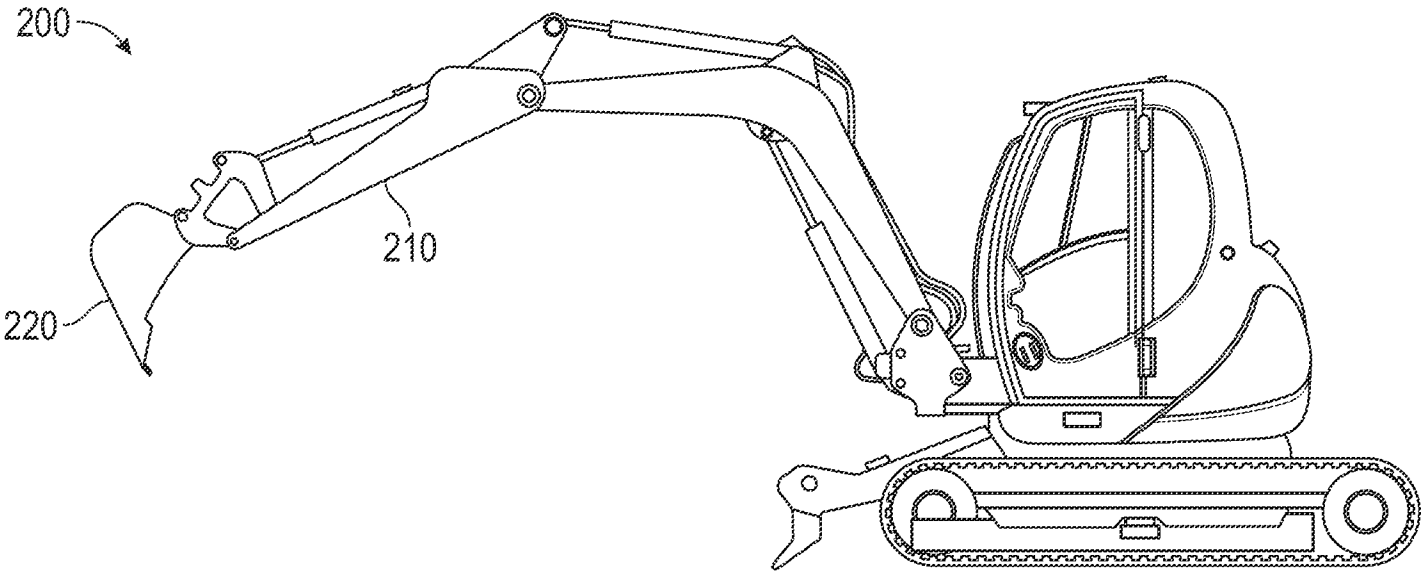
FIG. 12 is a perspective view of the prior art excavator.

An embodiment of the invention, as shown and described by the various figures and accompanying text, provides a pin-on boom extension system 100 for an excavator 200, specifically, a mini-excavator. As depicted in FIG. 12, known excavators may have booms 210 of fixed length. An attachment 220 may be secured to the boom 210. One attachment 220 may be removed and replaced by a different attachment 220 using a known pin-on system. The pin-on boom extension system 100 may be secured to the excavator 200 between the existing boom 210 and the attachment 220. An attachment end of the pin-on boom extension system 100 may be secured to the attachment 220, which may be, by way of example, and not as a limitation, a bucket, auger drive, brush cutter, mulcher concrete breaker, trencher, pallet fork, plate compactor, ripper, packer wheel, or the like. The pin-on boom extension system 100 may be quickly and easily removed from or attached to the boom 210.

The pin-on boom extension system 100 may include a top bar 110, bottom boom tube 120, pivot bars 130, 180, and adjustment plates 140.

The top bar 110 may have an attachment end 111 and a boom end 112. The top bar 110 may be an elongate member with the attachment end 111 opposing the boom end 112 and a length of the top bar 110 disposed between the two. An attachment end 111 of the top bar 110 may be configured to secure to an attachment 220. A boom end 112 of the top bar 110 may be secured to a second end 132 of a first pivot bar 130 and a second end 182 of a second pivot bar 180.

There may be at least two pivot bars 130, 180. The pivot bars may each have a first end 131, 181 and an opposing second end 132, 182. A first end 131 of the first pivot bar 130 may be secured to the bottom boom tube 120. Specifically, the first end 131 of the first pivot bar 130 may be secured to a first side 127 of the boom end 122 of the bottom boom tube 120. A first end 181 of the second pivot bar 180 may also be secured to the bottom boom tube 120. Specifically, the first end 181 of the second pivot bar 180 may be secured to the second side 128 of the boom end 122 of the bottom boom tube 120. A second end 132 of the first pivot bar 130 may be secured to the boom end 112 of the top bar 110. A second end 182 of the second pivot bar 180 may be secured to the boom end 112 of the top bar 110. Both the bottom boom tube 120 and the top bar 110 may be rotatably secured to the pivot bars 130, 180. Such a configuration may allow the attachment end 111 of the top bar 110 and the attachment end 121 of the bottom boom tube 120 to pivot relative to the pivot bars 130, 180.

A first tube 194 may be secured to the boom end 112 of the top bar 110. The length of the first tube 194 may run perpendicular to the length of the top bar 110. A second tube 195 may be secured to the boom end 112 of the top bar 110. The length of the second tube 195 may run perpendicular to the length of the top bar 110. A center of the void defined by the first tube 194 may align with a center of the void defined by the second tube 195. A fastener may be carried by the first tube 194 to secure the top bar 110 to the first pivot bar 130. A different fastener may be carried by the second tube 195 to secure the top bar 110 to the second pivot bar 180.

The top bar 110 may include an elongated cylindrical member 113, which may extend from the attachment end 111 to the boom end 112 of the top bar 110. A spreader bar 114 may be secured to a boom end 119 of the elongated cylindrical member 113. The spreader bar 113 may be a planar structure and may be secured to the elongated cylindrical member 113 parallel to a plane intersecting a longitudinal axis of the elongated cylindrical member 113. The spreader bar 113 may be centered on a cross-section of the elongated cylindrical member 113. The spreader bar 113 may have a first end 115 and an opposing second end 116. The first end 115 and second end 116 may be separated by a length of the spreader bar 113. The spreader bar 116 may also have a first side 117 and an opposing second side 118. The first side 117 of the spread bar may extend from the first end 115 to the second end 116. The second side 118 of the spreader bar 114 may also extend from the first end 115 to the second end 116. The first side 117 and second side 118 may have equal lengths. The lengths of the first side 117 and second side 118 may be longer than the lengths of the first end 115 and second end 116. The first side 117 of the spreader bar may be secured to the elongated cylindrical member 113 or carried by the elongated cylindrical member 113 at the boom end 119. The first side 117 of the spreader bar 114 may be positioned closer to the attachment end 111 of the top bar 110 than the second side 118 of the spreader bar 114. An outer surface of the first tube 194 may be secured to the second side 118 of the spreader bar 114 at the first end 115 of the spreader bar 114. An outer surface of the second tube 195 may be secured to the second side 118 of the spreader bar 114 at the second end 116 of the spreader bar 114. A notch 196 may be formed along the second side 118 of the spreader bar 114 between the first end 115 and the second end 116 of the spreader bar 114. The notch 196 may be positioned between the first tube 194 and the second tube 195.

The top bar 110 may have an aperture 197 located in an attachment end 111 of the top bar 110. The aperture 197 may extend through an entirety of a thickness of the top bar 110 from a first side to an opposing second side. The aperture may be formed through a plane bisecting a longitudinal axis of the top bar 110. The aperture 197 may be configured to receive a pin to secure to the attachment 220.

Figure 1:
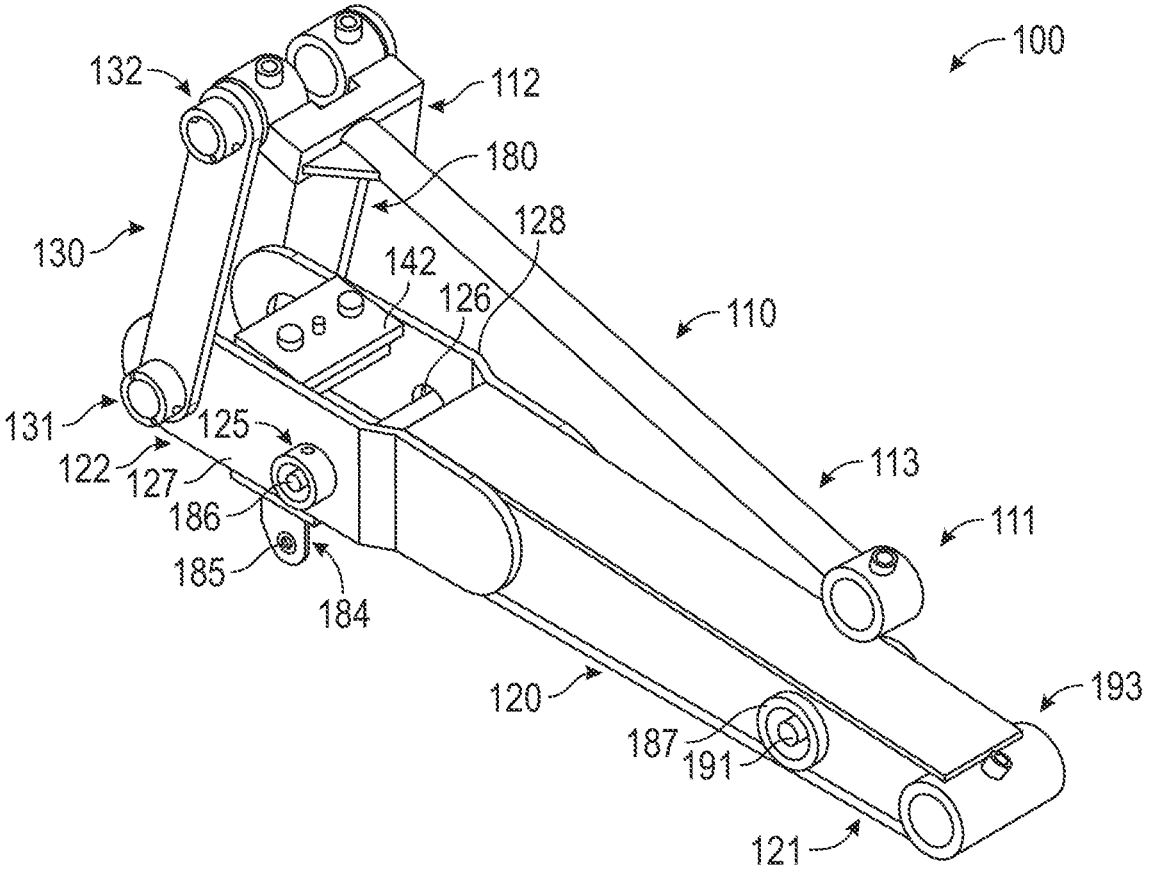
FIG. 1 is a perspective view of a pin-on boom extension system according to an embodiment of the present invention.
Figure 2:
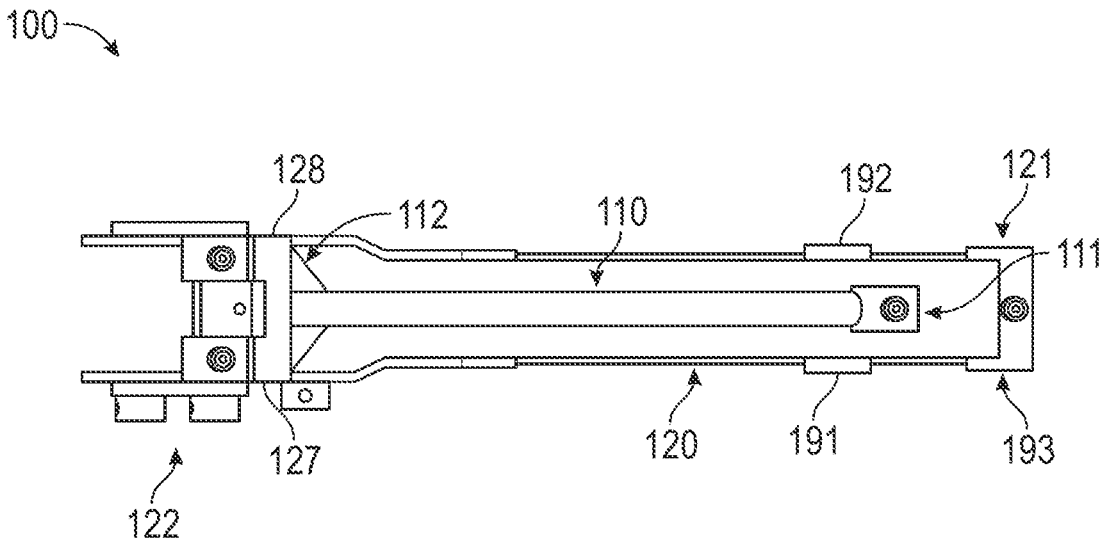
FIG. 2 is a top plan view of the pin-on boom extension system of FIG. 1.
Figure 3:
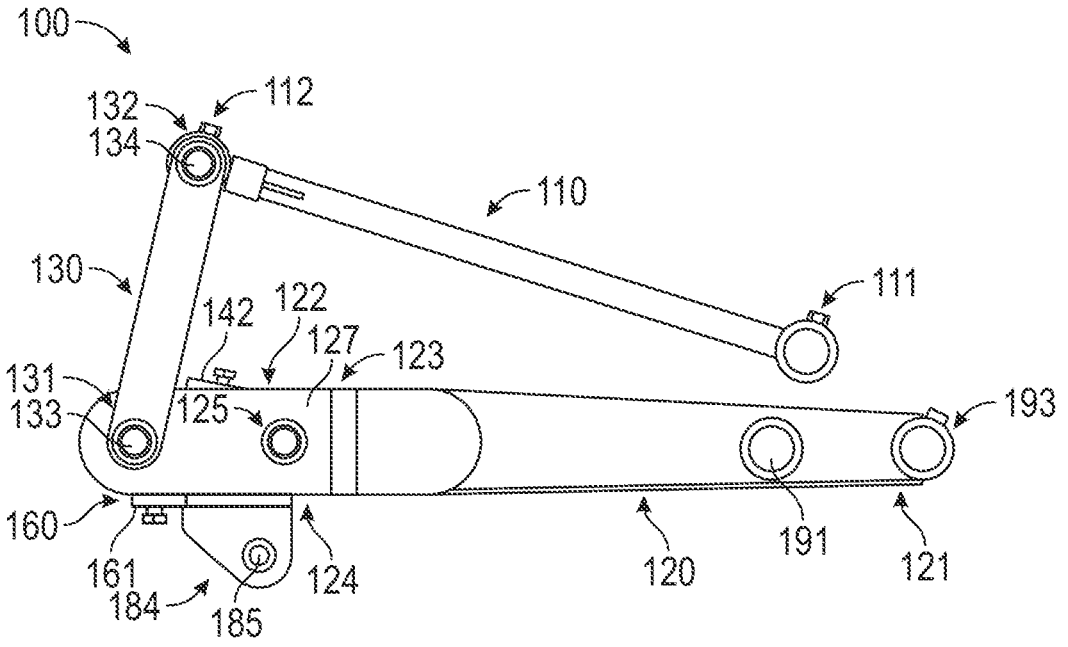
FIG. 3 is a side elevation view of the pin-on boom extension system of FIG. 1.
Figure 5:
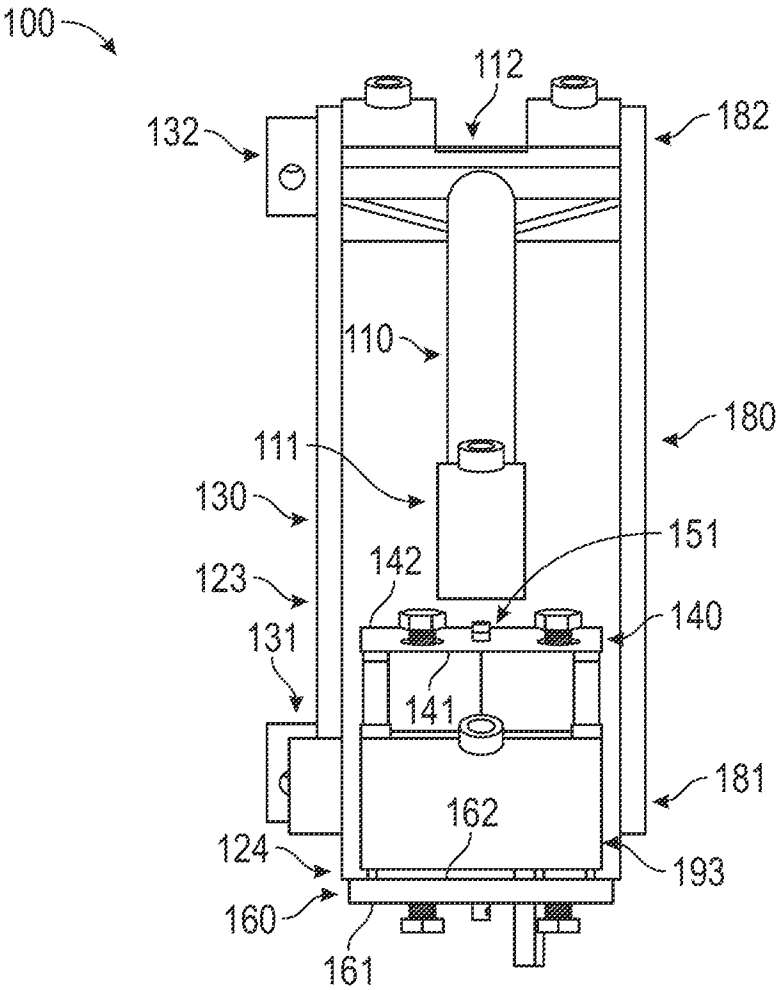
FIG. 5 is a front elevation view of the pin-on boom extension system of FIG. 1.
Figure 4:
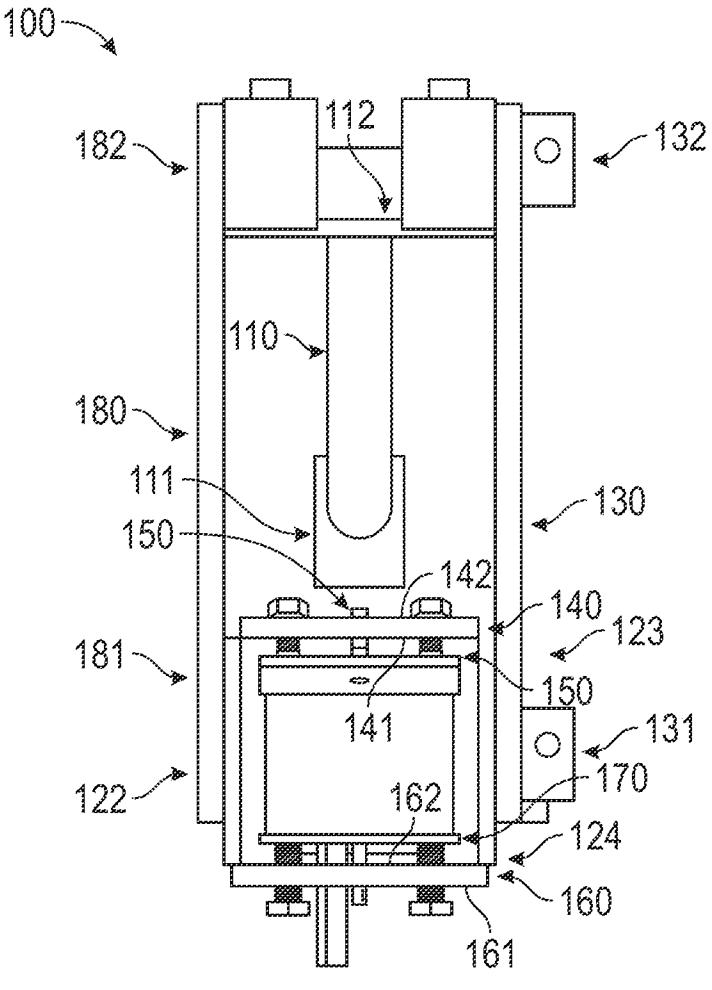
FIG. 4 is a rear elevation view of the pin-on boom extension system of FIG. 1.
Figure 6:
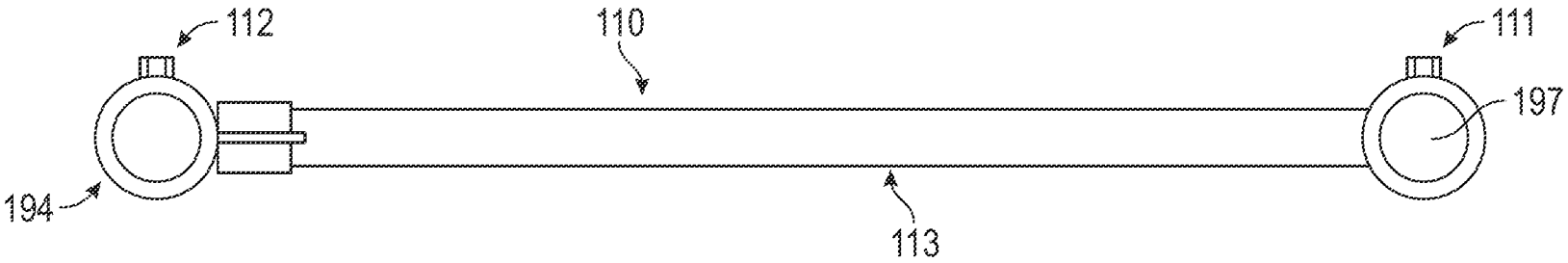
FIG. 6 is a side elevation view of a top bar of the pin-on boom extension system as depicted in FIG. 1.
Figure 7:
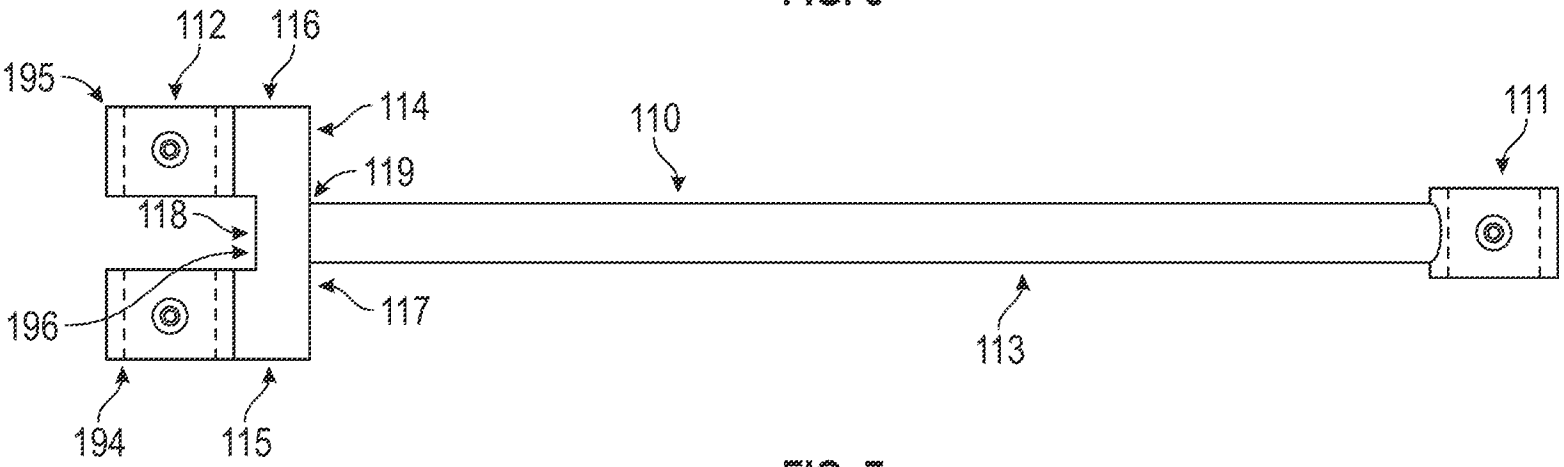
FIG. 7 is a top plan view of the top bar of FIG. 6.
Figure 8:
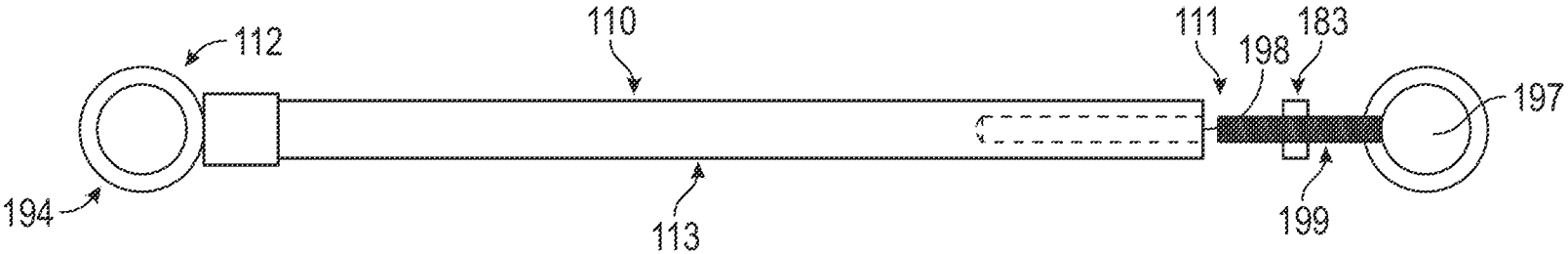
FIG. 8 is a side elevation view of a top bar of the pin-on boom extension system according to an embodiment of the invention.
Figure 9:
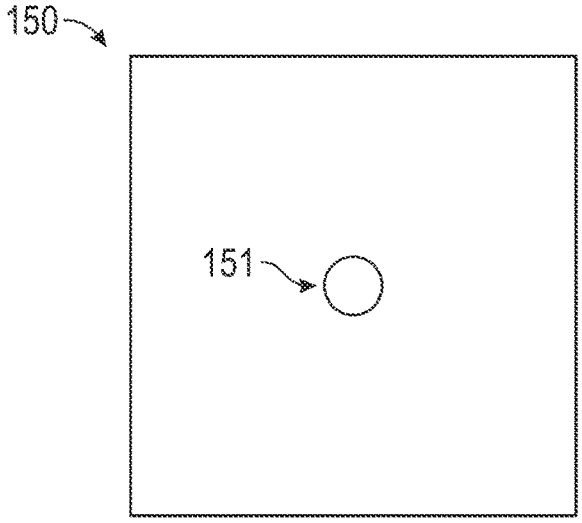
FIG. 9 is a top plan view of a wear plate of the pin-on boom extension system as depicted in FIG. 1.

In one embodiment, the effective length of the top bar 110 may be adjustable. In such an embodiment, as depicted at least in FIG. 8, a threaded aperture 198 may be formed in the attachment end of the elongated cylindrical member 113. The threaded aperture 198 may extend along a longitudinal axis of the elongated cylindrical member 113. The threaded aperture 198 may not extend through an entirety of the length of the elongated cylindrical member 113 but may have an opening at the attachment end 111 of the top bar 110. The threaded aperture 198 may be adapted to receive a threaded rod 199. The threaded rod 199 may have a first end that is carried by the threaded aperture 198. The length of the threaded rod 199 protruding from the threaded aperture 198 may be adjusted by positioning the threaded rod 199 either further within or further without the threaded aperture 198 as desired. A second end of the threaded rod 199, which opposes the first end, may be positioned outside of the threaded aperture. The second end may include a securing member 183, which may have an aperture. This securing member 183, may be utilized to secure an attachment 220 to the top bar 110.

A first aperture 133 may be formed through an entirety of a thickness of either pivot bar 130, 180 on the first end 131, 181 of the pivot bars 130, 180. A fastener may be positioned though each of the first apertures 133 to secure the pivot bars 130, 180 to the bottom boom bar 120. A second aperture 134 may be formed through an entirety of a thickness of the either pivot bar 130, 180 on the second end 132, 182 of the pivot bars 130, 180. A fastener may be positioned though each of the second apertures 134 to secure the pivot bars 130, 180 to the top bar 110.

The bottom boom tube 120 may have an attachment end 121, a boom end 122 opposing the attachment end 121, and an elongate portion extending between the two ends 121, 122. The boom end 122 of the bottom boom tube 120 may be configured to receive a free end of a boom 210 of an excavator 200. The free end of the boom 210 may be received in a void defined by sides of the bottom boom tube 120 at the boom end 122. The boom end 122 of the bottom boom tube 120 may have a first side 127 opposing a second side 128. Both the first side 127 and second side 128 may extend from an upper portion 123 of the bottom boom tube 120 to a lower portion 124 of the bottom boom tube 120.

The first pivot bar 130 may secure to an outside of the first side 127 and the second pivot bar 180 may secure to an outside of the second side 128. The inside of the first side 127 and the inside of the second side 128 may define the void within which the boom 210 may be carried. Both the first side 127 and second side 128 may be formed from elongate members that extend down a longitudinal axis of the bottom boom tube 120.

A first aperture 125 may be formed in the first side 127 and a second aperture 126 may be formed in the second side 128. Both the first aperture 125 and the second aperture 126 may be arcuate and they may have centers that aligned with one another along a plane projected on a longitudinal axis of the bottom boom tube 120. The first aperture 125 may be located through an entirety of a thickness of the first side 127 at a position between the connection point of the first pivot bar 130 to the bottom boom tube 120 and the attachment end 121 of the bottom boom tube 120. The second aperture 126 may be located through an entirety of a thickness of the second side 128 at a position between the connection point of the second pivot bar 180 to the bottom boom tube 120 and the attachment end 121 of the bottom boom tube 120. The first aperture 125 and second aperture 126 may be sized to allow a securing pin 186 to be carried by, inserted into, and removed from both apertures 125, 126. The securing pin 186 may be inserted into the apertures 125, 126 and pass through an aperture in the boom 210 to secure the pin-on boom extension system 100 to the excavator 200. The securing pin 186 may have an aperture to receive a cotter pin and secure the securing pin 186 within the first aperture 125 and second aperture 126.

A third aperture 191 may be formed in the first side 127 of the bottom boom tube 120 and a fourth aperture 192 may be formed in the second side 128 of the bottom boom tube 120. Both the third aperture 191 and the fourth aperture 192 may be arcuate and they may have centers that aligned with one another along a plane projected on a longitudinal axis of the bottom boom tube 120. The third aperture 191 may be located through an entirety of a thickness of the first side 127 at a position between the first aperture 125 and the attachment end 121 of the bottom boom tube 120. The fourth aperture 192 may be located through an entirety of a thickness of the second side 128 at a position between the second aperture 126 and the attachment end 121 of the bottom boom tube 120. The third aperture 191 and fourth aperture 192 may be sized to allow a securing pin 187 to be carried by, inserted into, and removed from both apertures 191, 192. The second securing pin 187 may be inserted into the apertures 191, 192 and pass through an aperture in the attachment 220 to secure the pin-on boom extension system 100 to the attachment 220. The second securing pin 187 may have an aperture to receive a cotter pin and secure the securing pin 187 within the third aperture 191 and fourth aperture 192.

The bottom boom tube 120 may also include a tube 193, which may be positioned at the attachment end 121 of the bottom boom tube 120. The tube 193, may be cylindrical and extend from a first side 127 to a second side 128 of the bottom boom tube 120. The length of the tube 193 may extend along a transverse axis of the bottom boom tube 129. The tube 193 may be sized to receive a portion of an attachment 220 and function cooperatively with the third aperture 191 and fourth aperture 192 to secure the attachment 220 to the pin-on boom extension system 100.

The bottom boom tube 120 may also include a plate 184 that extends down from a lower portion 124 of the bottom boom tube 120. The plate 184 may be a planar structure positioned in a plane parallel to a plane bisecting a longitudinal axis of the bottom boom tube 120. The plate 184 may be positioned closer to the boom end 122 of the bottom boom tube 120 than the attachment end 121 of the bottom boom tube 120. The plate 184 may have an aperture 185 formed through an entirety of a thickness of the plate 183. The aperture 184 may be positioned between the connection point of the pivot bar 130 to the bottom boom tube 120 and the first aperture 125. The aperture 185 may be formed so the void of the aperture 125 is parallel to the first side 127 and second side 128 of the bottom boom tube 120.

Figure 10A:
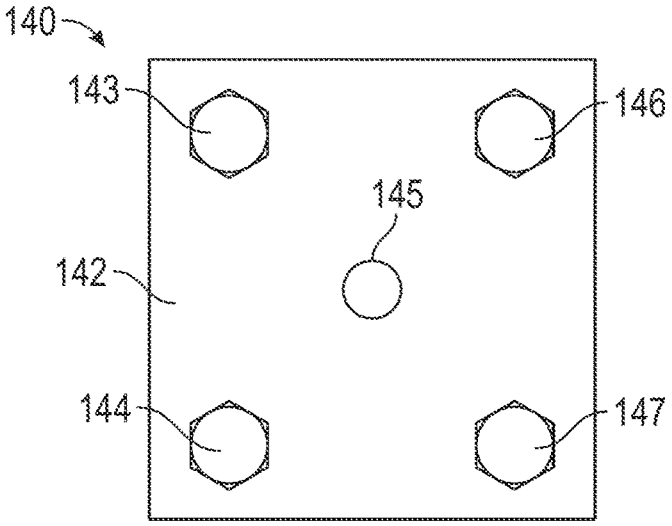
FIG. 10*a* is a top plan view of an adjustment plate of the pin-on boom extension system as depicted in FIG. 1.
Figure 10B:
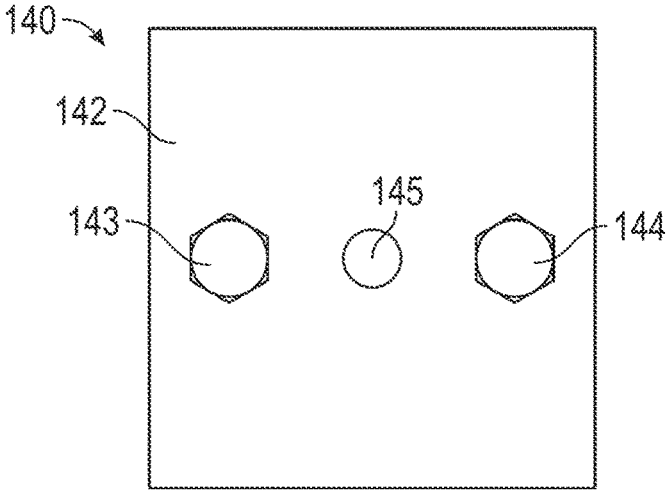
FIG. 10*b* is a top plan view of an adjustment plate of the pin-on boom extension system in accordance with another embodiment of the present invention.
Figure 11:
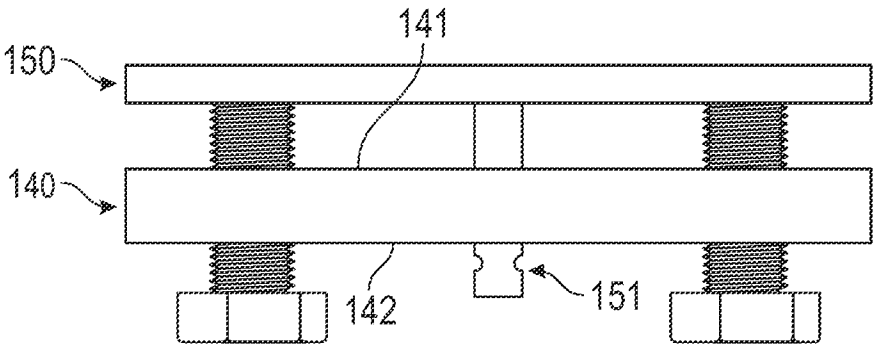
FIG. 11 is a side elevation view of the plate assembly of the pin-on boom extension as depicted in FIG. 1.

An adjustment plate 140 may be secured to the bottom boom tube 120. The adjustment plate 140 may be a planar member having an upper surface 142 and an opposing lower surface 141. The adjustment plate 140 may be positioned at an upper portion 123 of the bottom boom tube 120 and extend from the first side 127 of the bottom boom tube 120 to the second side 128 of the bottom boom tube 120. The adjustment plate 140 may be positioned proximate the boom end 122 of the bottom boom tube. There may be one or more apertures 143, 144, 146, 147 formed through an entirety of a thickness of the adjustment plate 140 from the upper surface 142 to the lower surface 141. One or more of these apertures 143, 144, 146, 147 may be threaded and adapted to receive a bolt. Some embodiments of the pin-on boom extension system 100 may have two of the apertures 143, 144, as depicted in FIG. 10*b*. Other embodiments may have four of the apertures 143, 144, 146, 147, as depicted in FIG. 10*a*. In embodiments in which one or more of the apertures 143, 144, 146, 147 are threaded, a bolt may be received by on each of the apertures 143, 144, 146, 147 present on the adjustment plate 140. The bolts may be adjusted independently of one another with a head end of the bolt proximate the upper surface 142 of the adjustment plate 140 and the opposing, terminal end of the bolt extending through the thickness of the adjustment plate 140 to contact with a portion of the boom 210 carried by the bottom boom tube 120. In embodiments that include a wear plate 150, 170, the bolts may contact the wear plates 150, 170 rather than the boom 210. Adjustment of the bolts will place pressure on the boom 210, either directly or through the wear plates 150, 170, and form an interference fit to position the boom 210 within the bottom boom tube 210 at an operable position.

A fifth aperture 145 (or third aperture 145 in embodiment with only two bolt apertures 143, 144) may be formed through an entirety of the thickness of the adjustment plate 140. This aperture 145 may be configured to receive an alignment pin 151 located on a wear plate 150.

An second adjustment plate 160 may be secured to the bottom boom tube 120 opposing the first adjustment plate 140. The second adjustment plate 160 may be essentially identical to the first adjustment plate 140. The second adjustment plate 160 may also be a planar member having an upper surface 162 and an opposing lower surface 161. The second adjustment plate 160 may be positioned at a lower portion 124 of the bottom boom tube 120 and extend from the first side 127 of the bottom boom tube 120 to the second side 128 of the bottom boom tube 120. The second adjustment plate 160 may be positioned proximate the boom end 122 of the bottom boom tube. The upper surface 162 of the second adjustment plate 160 may opposed the lower surface 141 of the first adjustment plate 140. There may be one or more apertures 143, 144, 146, 147 formed through an entirety of a thickness of the second adjustment plate 160 from the upper surface 162 to the lower surface 161. One or more of these apertures 143, 144, 146, 147 may be threaded and adapted to receive a bolt. Some embodiments of the pin-on boom extension system 100 may have two of the apertures 143, 144, as depicted in FIG. 10*b*. Other embodiments may have four of the apertures 143, 144, 146, 147, as depicted in FIG. 10*a*. In embodiments in which one or more of the apertures 143, 144, 146, 147 are threaded, a bolt may be received by on each of the apertures 143, 144, 146, 147 present on the second adjustment plate 160. The bolts may be adjusted similarly to the bolts of the first adjustment plate 140. Adjustment of the bolts will place pressure on the boom 210, either directly or through a wear plate 150, 170, and form an interference fit to position the boom 210 within the bottom boom tube 210 at an operable position.

A fifth aperture 145 (or third aperture 145 in embodiment with only two bolt apertures 143, 144) may be formed through an entirety of the thickness of the second adjustment plate 160. This aperture 145 may be configured to receive an alignment pin 151 located on a second wear plate 170.

A first wear plate 150 may be positioned between the first adjustment plate 140 and the boom 210 when the boom is carried by the bottom boom tube 120. The first wear plate 150 may be a planar member. The first wear plate 150 may be proximate the first adjustment plate 140 and located between the first side 127 and second side 128 of the bottom boom tube 120, between the first adjustment plate 140 and second adjustment plate 160, and along the lower surface 141 of the first adjustment plate 140. The upper surface of the first wear plate 150 may contact the lower surface 141 of the first adjustment plate 140. The first wear plate 150 may include a pin 151 extending upwardly from an upper surface of the first wear plate 150, orthogonal to the plane of the wear plate 150. The pin 151 may extend through an aperture 145 formed in the adjustment plate 140. A cotter pin may be secured through an aperture in the pin 151 to secure the wear plate 150 to the adjustment plate 140. The wear plate 150 may advantageously receive friction from the bolts passing through the first adjustment plate 140 to put pressure on the boom 210 carried within the bottom boom tube 120. The friction caused by one or more of these bolts may erode portions of the wear plate 150. The wear plate 150 may be removed and replaced from the pin-on boom extension system 100 by simply removing and replacing the cotter pin securing the wear plate 150 to the adjustment plate 140.

A second wear plate 170 may be positioned between the second adjustment plate 160 and the boom 210 when the boom is carried by the bottom boom tube 120. The second wear plate 170 may also be a planar member. The second wear plate 170 may be proximate the second adjustment plate 160 and located between the first side 127 and second side 128 of the bottom boom tube 120, between the first adjustment plate 140 and second adjustment plate 160, and along the upper surface 161 of the second adjustment plate 160. The lower surface of the second wear plate 170 may contact the upper surface 162 of the second adjustment plate 160. The second wear plate 170 may include a pin extending downwardly from a lower surface of the second wear plate 170 orthogonal to the plane of the wear plate 170. The pin may extend through an aperture formed in the adjustment plate. A cotter pin may be secured through an aperture in the pin to secure the second wear plate 170 to the second adjustment plate 160. The second wear plate 170 may advantageously receive friction from the bolts passing through the second adjustment plate 160 to put pressure on the boom 210 carried within the bottom boom tube 120. The friction caused by one or more of these bolts may erode portions of the wear plate 170. The wear plate 170 may be removed and replaced from the pin-on boom extension system 100 by simply removing and replacing the cotter pin securing the wear plate 170 to the adjustment plate 160.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. A pin-on boom extension system for an excavator having a boom and an attachment, wherein the boom extension system comprises:

a top bar having an attachment end and an opposing boom end;

a bottom boom tube having an attachment end and an opposing boom end adapted to receive a free end of the boom, further comprising:

a first aperture having a center and located on a first side of the bottom boom tube between a first end of a first pivot bar and the attachment end of the bottom boom tube, and a second aperture having a center located on a second side of the bottom boom tube between a first end of a second pivot bar and the attachment end of the bottom boom tube, and wherein the center of the first aperture is aligned with the center of the second aperture;

a first securing pin adapted to extend through the first aperture of the bottom boom tube and the second aperture of the bottom boom tube;

the first pivot bar having the first end secured to the first side of the boom end of the bottom boom tube and a second end secured to the boom end of the top bar;

the second pivot bar having the first end secured to the second side of the boom end of the bottom boom tube and a second end secured to the boom end of the top bar;

a first adjustment plate having a lower surface and an opposing upper surface, wherein the first adjustment plate is positioned at an upper portion of the bottom boom tube proximate the boom end and extending from the first side of the bottom boom tube to the second side of the bottom boom tube; and a second adjustment plate having a lower surface and an opposing upper surface positioned proximate the lower surface of the first adjustment plate, wherein the second adjustment plate is positioned at a lower portion of the bottom boom tube proximate the boom end and extending from the first side of the bottom boom tube to the second side of the bottom boom tube.

2. The boom extension system of claim 1 wherein the bottom boom tube further comprises:

a third aperture having a center and located on a first side of the bottom boom tube between the first aperture and the attachment end of the bottom boom tube;

a fourth aperture having a center located on a second side of the bottom boom tube between the second aperture and the attachment end of the bottom boom tube; and a second securing pin adapted to extend through the third aperture of the bottom boom tube and the fourth aperture of the bottom boom tube; and wherein the center of the third aperture is aligned with the center of the fourth aperture.

3. The boom extension system of claim 1 wherein the bottom boom tube further comprises a first tube located on the attachment end and extending from the first side of the bottom boom tube to the second side of the bottom boom tube.

4. The boom extension system of claim 1 wherein the bottom boom tube further comprises a plate extending downwardly from a lower portion of the bottom boom tube proximate the boom end of the bottom boom tube, wherein the plate has an aperture extending entirely through a thickness of the plate.

5. The boom extension system of claim 1 wherein the first pivot bar comprises:

a first aperture formed through an entirety of a thickness of the first pivot bar on the first end of the pivot bar; and a second aperture formed through an entirety of the thickness of the first pivot bar on the second end of the pivot bar.

6. The boom extension system of claim 1 wherein the first adjustment plate further comprises:

a first threaded aperture located through an entirety of a thickness of the first adjustment plate; and a second threaded aperture located through an entirety of the thickness of the first adjustment plate.

7. The boom extension system of claim 6 wherein the first adjustment plate further comprises:

a third aperture located through an entirety of the thickness of the first adjustment plate.

8. The boom extension system of claim 7 wherein the first adjustment plate further comprises:

a fourth threaded aperture located through an entirety of a thickness of the first adjustment plate; and a fifth threaded aperture located through an entirety of the thickness of the first adjustment plate.

9. The boom extension system of claim 6 wherein the second adjustment plate further comprises:

a first threaded aperture located through an entirety of a thickness of the second adjustment plate; and a second threaded aperture located through an entirety of the thickness of the second adjustment plate.

10. The boom extension system of claim 1 further comprising:

a first wear plate positioned between the first adjustment plate and the second adjustment plate.

11. The boom extension system of claim 10 further comprising:

a second wear plate positioned between the second adjustment plate and the first wear plate.

12. The boom extension system of claim 10 wherein the first wear plate includes a pin extending orthogonally from a surface of the first wear plate proximate the first adjustment plate and wherein the pin extends through an alignment hole disposed through an entirety of a thickness of the first adjustment plate.

13. The boom extension system of claim 1 wherein the pivot bar is rotatably secured to the boom end of the bottom bar and the boom end of the top bar.

14. The boom extension system of claim 1 wherein the top bar is rotatably secured to first pivot bar and rotatably secured to the second pivot bar.

15. The boom extension system of claim 14 wherein the top bar comprises:

a first tube having a center located at the boom end; and a second tube having a center located at the boom end; and wherein the center of the first tube is aligned with the center of the second tube.

16. The boom extension system of claim 15 wherein the top bar further comprises:

an elongated cylindrical member; and a spreader bar having a first end and an opposing second end and a first side and an opposing second side wherein the first side of the spreader bar is secured to a boom end of the elongated cylindrical member across a transverse axis of the elongated cylindrical member; and wherein an outer surface of the first tube is secured to the second side of the spreader bar at the first end of the spreader bar and an outer surface of the second tube is secured to the second side of the spreader bar at the second end of the spreader bar.

17. The boom extension system of claim 16 wherein a notch is formed along the second side of the spreader bar between the first tube and the second tube.

18. The boom extension system of claim 14 wherein the top bar has an aperture located at the attachment end extending through an entirety of a thickness of the top bar from a first side to an opposing second side.

19. The boom extension system of claim 1 wherein the top bar comprises:

a threaded aperture located at the attachment end of the top bar along a longitudinal axis of the top bar; and a threaded rod having a first end carried by the threaded aperture, a second, opposing end, and a securing member located on the second end of the threaded rod.

* * * * *